US010414562B2

(12) United States Patent
Giovannini et al.

(10) Patent No.: US 10,414,562 B2
(45) Date of Patent: Sep. 17, 2019

(54) CLOSURES WITH STORAGE CHAMBERS

(71) Applicant: Guala Closures S.p.A., Alessandria (IT)

(72) Inventors: Marco Giovannini, Milan (IT); Luca Viale, Alessandria (IT); Maurizio Mittino, Castelletto Monferrato (IT)

(73) Assignee: GUALA CLOSURES S.P.A., Alessandria (IT)

( * ) Notice: Subject to any disclaimer, the term of this patent is extended or adjusted under 35 U.S.C. 154(b) by 208 days.

(21) Appl. No.: 15/319,175

(22) PCT Filed: Jun. 18, 2015

(86) PCT No.: PCT/IB2015/054588
§ 371 (c)(1),
(2) Date: Dec. 15, 2016

(87) PCT Pub. No.: WO2015/193835
PCT Pub. Date: Dec. 23, 2015

(65) Prior Publication Data

US 2017/0152084 A1 Jun. 1, 2017

(30) Foreign Application Priority Data

Jun. 19, 2014 (IT) ..... MI2014A1118
Aug. 6, 2014 (IT) ..... MI2014A1446

(51) Int. Cl.
*B65D 51/28* (2006.01)
*B65D 1/02* (2006.01)
*B65D 41/04* (2006.01)

(52) U.S. Cl.
CPC ..... *B65D 51/2864* (2013.01); *B65D 1/0246* (2013.01); *B65D 41/04* (2013.01)

(58) Field of Classification Search
CPC ..... B65D 51/2864; B65D 51/2857; B65D 51/2871; B65D 51/2892; B65D 41/0407; B65D 41/28; B65D 41/04; B65D 1/0246
(Continued)

(56) References Cited

U.S. PATENT DOCUMENTS 6,763,939 B2 7/2004 Alticosalian
2005/0016875 A1* 1/2005 Rodriguez ..... B65D 51/2814 206/219
2009/0321286 A1* 12/2009 Frutin ..... B65D 51/2892 206/219

FOREIGN PATENT DOCUMENTS

DE 2200536 A1 7/1973
DE 29916436 U1 3/2001
(Continued)

OTHER PUBLICATIONS

International Search Report and Written Opinion for PCT/IB2015/054588 dated Oct. 9, 2015.

*Primary Examiner* — Andrew D Perreault
(74) *Attorney, Agent, or Firm* — MH2 Technology Law Group LLP

(57) ABSTRACT

The present invention relates to a closure including a first stationary part and a second removable part. The second part includes a storage chamber and a dispensing opening. The first part includes a closing member and at least one passage opening. Upon first opening, the second part moves relative to the first part from a first configuration to a second configuration to cause the dispensing opening to disengage from the closing member and allow the product in the storage chamber to flow out into the container. In the first configuration, the first part engages the second part to form a first sealing portion, a second sealing portion, and a safety chamber arranged between the first sealing portion and the second sealing portion.

20 Claims, 5 Drawing Sheets

(58) Field of Classification Search
USPC ..... 206/221; 215/DIG. 8
See application file for complete search history.

(56) References Cited

FOREIGN PATENT DOCUMENTS

| | | | |
|---|---|---|---|
| EP | 1919791 | B1 | 5/2008 |
| EP | 2292525 | A1 | 3/2011 |
| WO | 2009020294 | A1 | 2/2009 |
| WO | 2009069953 | A2 | 6/2009 |
| WO | 2014030818 | A1 | 2/2014 |

* cited by examiner

CLOSURES WITH STORAGE CHAMBERS

CROSS-REFERENCE TO RELATED APPLICATION(S)

This application is a national stage entry from International Application No. PCT/IB2015/054588, filed on Jun. 18, 2015, in the Receiving Office ("RO/IB") of the World Intellectual Property Organization ("WIPO"), and published as International Publication No. WO 2015/193835 A1 on Dec. 23, 2015, and claims priority under 35 U.S.C. § 119 from Italian Patent Application No. MI 2014 A 001118, filed on Jun. 19, 2014, in the Italian Patent and Trademark Office, and also claims priority under 35 U.S.C. § 119 from Italian Patent Application No. MI 2014 A 001446, filed on Aug. 6, 2014, in the Italian Patent and Trademark Office, the entire contents of all of which are incorporated herein by reference.

BACKGROUND

Field

The present invention relates to closures with storage chambers.

Description of Related Art

Closures with storage chamber or reservoir are mainly used in the field of extemporaneous preparations.

Extemporaneous preparations are prepared by mixing a given amount of liquid stored in a container, typically sterile water, with a given amount of product (in liquid, powder, or other form), which is typically stored in a reservoir contained in the cap that closes the container.

This ensures stability of the products for a long time, as they are separately packaged and will be only mixed when the preparation is used.

Recently, closures with a storage chamber have also been found to be useful for beverages. In the field of alcoholic beverages, the product stored in the storage chamber may be a liquid or powder die which imparts a color to the beverage that makes it look more appealing to a consumer. In the field of non-alcoholic beverages and supplements, the product stored in the storage chamber may be a granular preparation.

A first type of closure uses a punch member which pierces the bottom of the storage chamber, upon first opening, to release the product stored therein into the container.

A second type of closure uses a closing member which disengages from a dispensing opening of the storage chamber, upon first opening, to release the product stored therein into the container. Closures of this type are disclosed, for instance in EP 2 292 525, DE 29916436, U.S. Pat. No. 6,763,939, and EP 1919791. These closures are composed of a stationary part, attached to the container, and a removable part. The removable part is equipped with a storage chamber with a dispensing opening closed by a closing member supported by the stationary part. Upon first opening, the dispensing opening disengages from the closing member and allows the product in the storage chamber to fall into the container by gravity.

This second type of closures is widely used, as it features a simple mechanism for opening and dispensing the product into the container, which has no frangible part and hence ensures a reliable operation. Nevertheless, these closures have a drawback. Due to the relaxation of the material that forms the two parts or the clearances caused by design or mass-production tolerances, particularly in the sealing area between the closing member and the dispensing opening, a small amount of the product stored in the storage chamber may be released therefrom into the container. This problem is particularly felt in the field of extemporaneous preparations, in which even a small amount of product may contaminate the sterile liquid and prevent use of the preparation once the container is opened. In the field of beverages, while contact of the product to be mixed with the liquid in the container, before first opening, does not affect the integrity of the liquid, it is still unpleasant to the consumer, e.g. in case of liquid dies, when the consumer buys a container with a partially colored liquid, and will not have the pleasure of looking at the effect of the dye upon first opening.

SUMMARY

The object of the present invention is to provide a closure with a storage chamber that can solve the above described problems.

According to the present invention, this object is fulfilled by a closure as defined in claim 1.

BRIEF DESCRIPTION OF THE DRAWINGS

The characteristics and advantages of the present invention will appear from the following detailed description of one practical embodiment, which is illustrated without limitation in the annexed drawings, in which.

DETAILED DESCRIPTION

Figure 1:
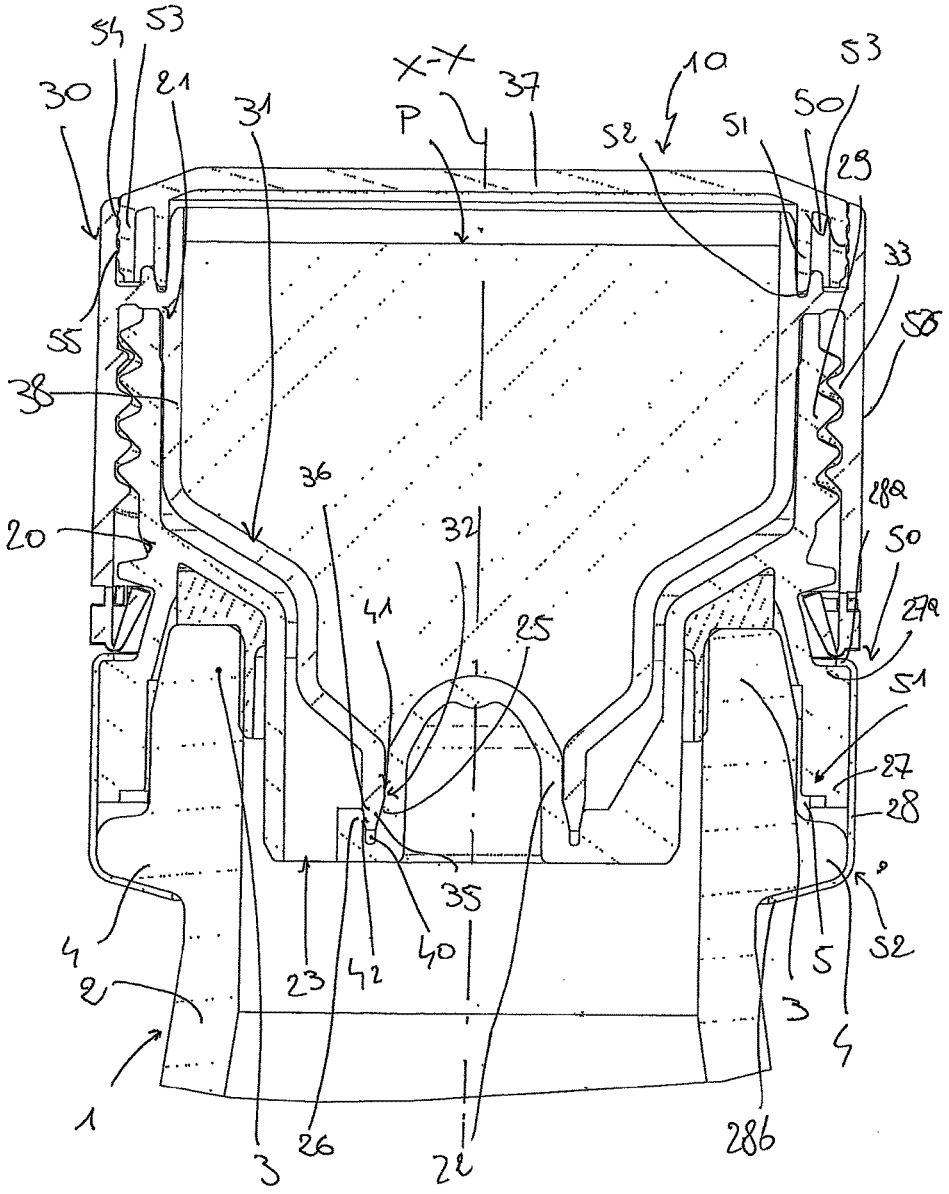
FIG. 1 shows a cross-sectional plan view of a closure according to a first embodiment of the present invention, in a first operating configuration.

Referring to the annexed figures, numeral 10 generally designates a closure according to an embodiment of the present invention.

The closure 10 extends along a longitudinal direction X-X and comprises a first part 20 and a second part 30.

The first part 20 is able to be firmly attached to a container 1 and has a pouring orifice 21 for pouring the contents of the container 1.

In this example, the container 1 comprises a neck 2, a mouth 3, and a bead 4.

In one embodiment, the first part 20 comprises attachment members 50 for rotationally and longitudinally attaching the first part 20 to the container 1.

Preferably, the attachment members 50 comprise rotational attachment members 51 and longitudinal attachment members 52. In this example, the rotational attachment members 51 comprise longitudinal ribs internally formed on the first part 20, particularly on a collar 27 of the first part 20, and able to engage longitudinal protrusions 5 externally formed on the neck 2 of the container 1, whereas the longitudinal attachment members 52 comprise a tubular band 28 arranged outside the collar 27, whose upper end 28*a* and lower end 28*b* are engaged with the upper part 27*a* of the collar 27 and the bead 4 respectively.

The second part 30 is removably coupled to the first part 20 to close and opening the pouring orifice 21 and allow the liquid in the container 1 to be poured out.

In one embodiment, the first part 20 and the second part 30 are coupled together by a threaded portion 29 externally formed on the first part 20 and a threaded portion 33 internally formed on the second part 30.

The second part 30 comprises a storage chamber 31 for storing a product P to be dispensed into the container 1 upon first opening of the closure 10.

The storage chamber 31 has a dispensing opening 32 at its bottom for allowing the product P to flow out of the storage chamber 31.

According to a first embodiment, the storage chamber 31 is closed at its top by a transverse wall 37 and at its sides by an annular wall 38 which terminates with the dispensing opening 32 at its bottom.

According to a second embodiment, the storage chamber 31 comprises a tubular element 38 having a filling opening 39 at its top, for introducing the product P to be dispensed into the storage chamber 31, and the dispensing opening 32 at its bottom. The lid 37 is fixed to the tubular element 38, to seal the filling opening 39. Thus, the lid 37 is not formed of one piece with the tubular element 38 but is fixed thereto. This allows the storage chamber 31 to be filled with the product P even when the closure 10 has already been mounted to the container 1, whereupon the filling opening 39 may be closed by the lid 37. This structure of the storage chamber 31 also allows the diameter of the filling opening 39 to be chosen irrespective of the diameter of the dispensing opening 32, and particularly allows the filling opening 39 to have a larger area than the dispensing opening 32. Thus, all the available volume may be utilized to form the storage chamber 31, as allowed by the diameter of the mouth 3 of the container 1. In order to seal the filling opening 39, the lid 37 may be fixed to the tubular element 38 by welding, e.g. ultrasonic welding, or gluing. Alternatively, the lid 37 may be equipped with fixing and sealing members 50, allowing both the lid 37 to be firmly fixed to the tubular element 30 and the filling opening 39 to be sealed. In one embodiment, the fixing and sealing members 50 are configured to provide removable fixation of the lid 37. In this example, the sealing fixation members 50 comprise a first sleeve 51 which downwardly projects out of the lid 37 and is engaged in an annular seat 52 formed at the top of the tubular element 38, and a second sleeve 53 having outer circumferential ribs 54 which engage circumferential ribs 55 internally formed on a wall 56 connected to the tubular element 38. Advantageously, the dispensing opening 32 has a dispensing area and the filling opening 39 has a filling area, which is greater than the dispensing area.

Figure 3:
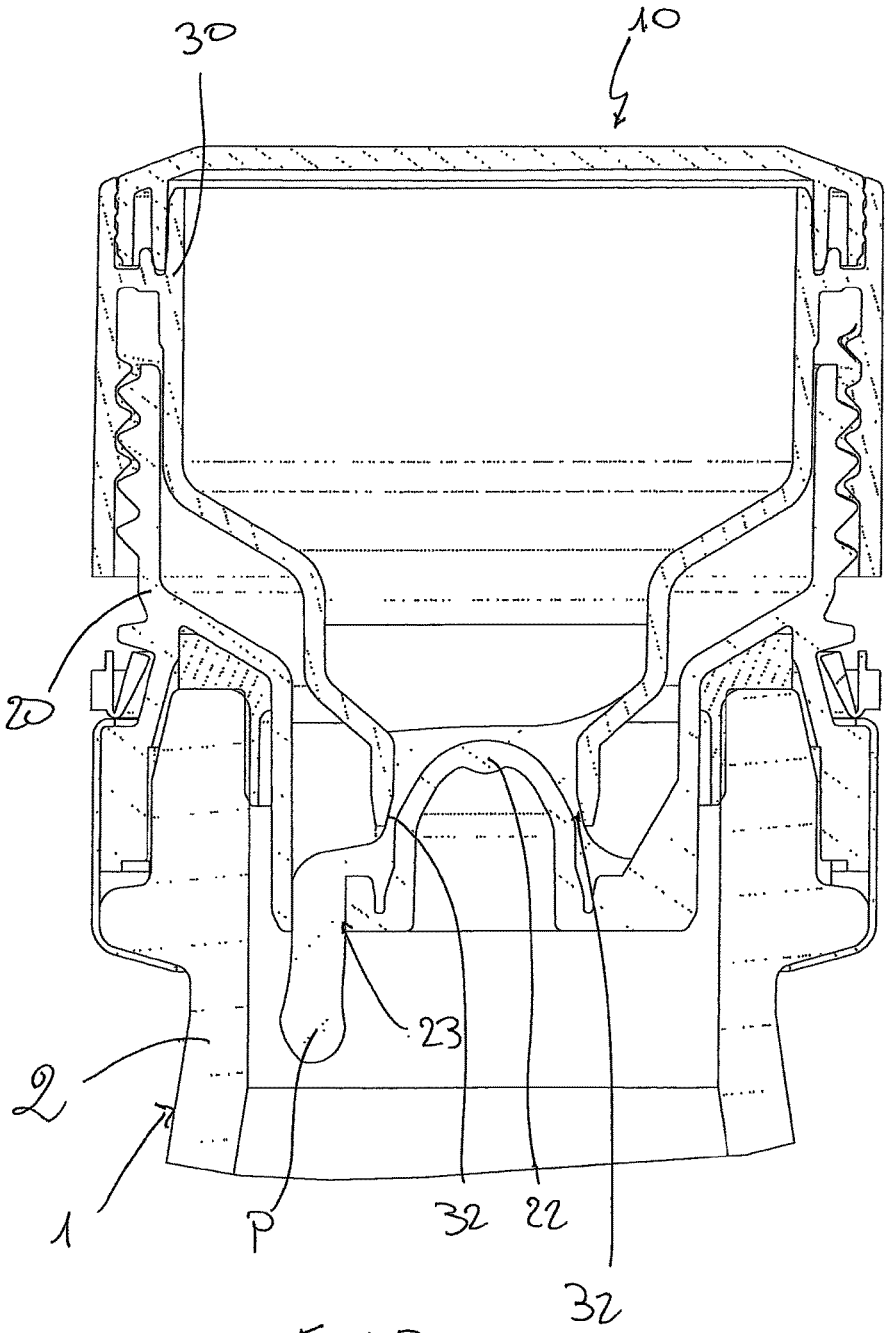
FIG. 3 shows a cross-sectional plan view of the closure of FIG. 1, in a second operating configuration.
Figure 4:
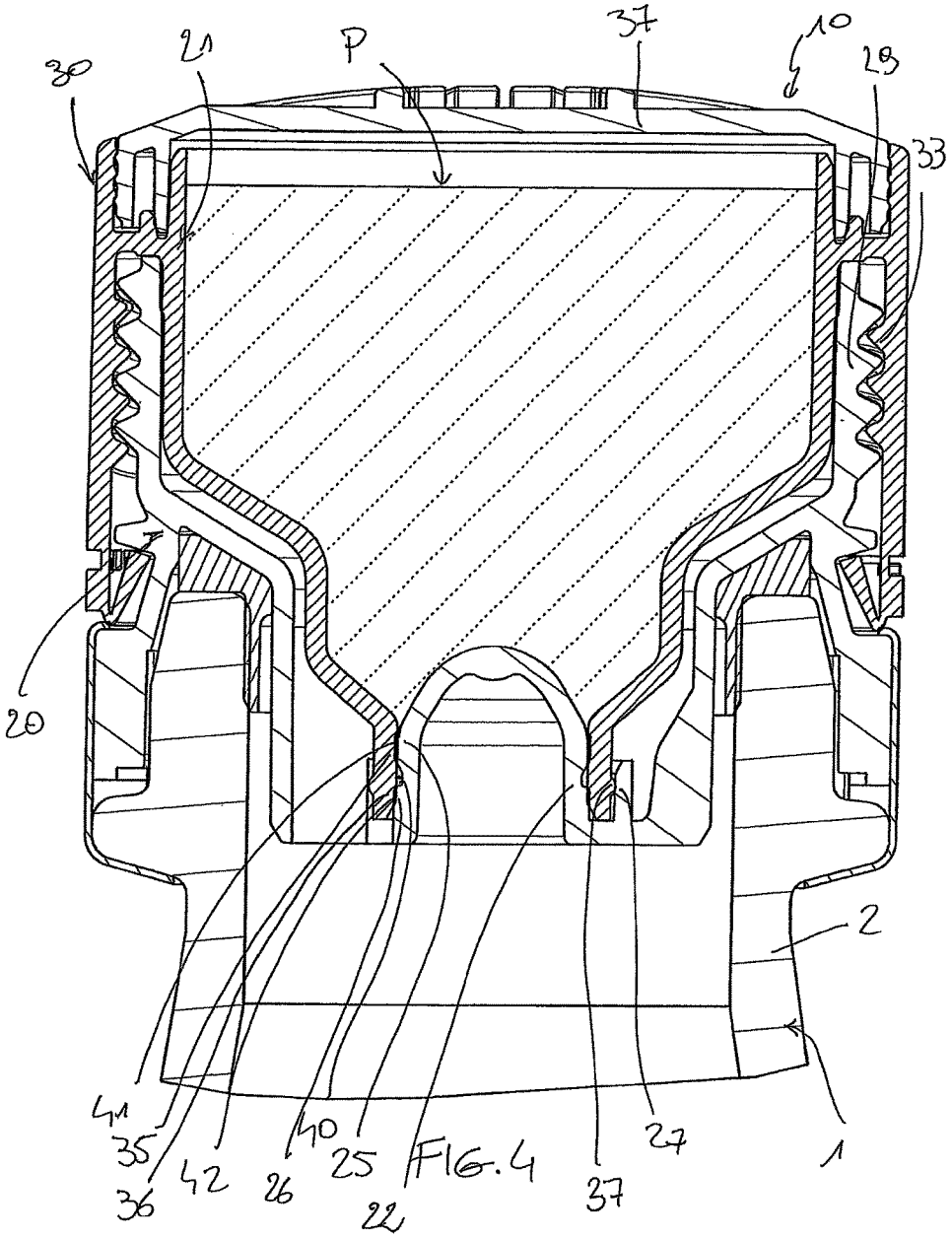
FIG. 4 shows a cross-sectional plan view of a closure according to a second embodiment of the present invention, in a first operating configuration.
Figure 5:
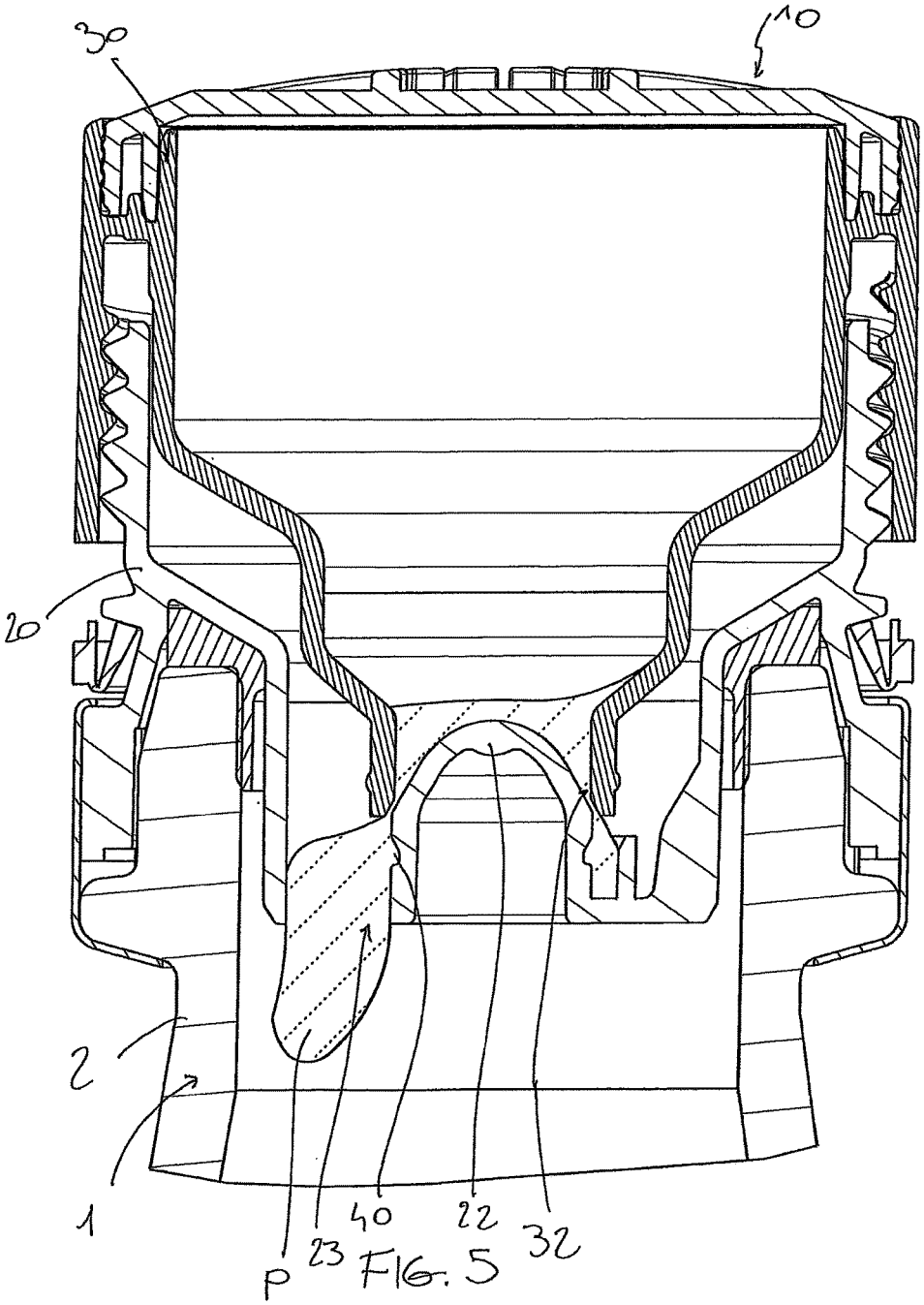
FIG. 5 shows a cross-sectional plan view of the closure of FIG. 4, in a second operating configuration.

The second part 30 is movable relative to the first part 20 between a first configuration (FIG. 1 and FIG. 4) and a second configuration (FIG. 3 and FIG. 5). Particularly, before first opening, the second part 30, in the first configuration, prevents the product P from flowing out of the dispensing opening 32 whereas, upon first opening, in the second configuration, it allows the product P to flow out of the dispensing opening 32 and mix with the product stored in the container 1.

For this purpose, the first part 20 comprises a closing member 22 and at least one passage opening 23, in this example three passage openings, angularly spaced by 120°. For brevity, reference will be made hereinafter, without limitation, to one passage opening 23.

The passage opening 23 is able to put the dispensing opening 32 of the storage chamber 31 in communication with the interior of the container 1.

Particularly, in the first configuration, before first opening, the closing member 22 closes the dispensing opening 32 and prevents the product P from flowing out of the dispensing opening 32 into the container.

Upon first opening, the second part 30 moves relative to the first part 20, and hence also relative to the container 1, from the first configuration to the second configuration to disengage the dispensing opening 32 from the closing member 22 and allow the product P in the storage chamber 31 to flow out into the container 1 through the dispensing opening 32 and the passage opening 23.

Advantageously, in the first configuration, the first part 20 engages the second part 30, particularly at the dispensing opening 32, to form a first sealing portion 41, a second sealing portion 42 and a safety chamber 40 arranged between the first sealing portion 41 and the second sealing portion 42.

On the one hand, the first sealing portion 41, the second sealing portion 42, and the safety chamber 40 arranged between the two sealing portions 41, 42 prevent even minor portions of the product P in the storage chamber 31 from flowing out of the storage chamber 31 to reach the liquid in the container 1, and on the other hand, they prevent the liquid in the container 1 from contacting the product P in the storage chamber 31, for instance, when the container 1 is turned upside down before first opening.

Advantageously, the safety chamber 40 is defined by an annular seat arranged in the lower portion of the first part 20, adjacent to the closing member 22.

In one embodiment, the second sealing portion 42 is placed downstream from the first sealing portion 41 in the direction of outflow of the product P from the storage chamber 31 toward the dispensing opening 32, the passage opening 23 and hence toward the interior of the container 1.

Therefore, the first sealing portion 41 is arranged between the storage chamber 31 and the safety chamber 40 to prevent any leakage of the product P from the storage chamber 31, whereas the second sealing portion 42 is arranged between the safety chamber 40 and the interior of the container 1 to prevent even minor amounts of products P leaking from the first sealing portion 41 from reaching the interior of the container 1.

Thus, should a small amount of the product P leak through the first sealing portion 41, e.g. due to the loss of the interference fit required between the first sealing portion 41 and the second sealing portion 42, as a result of the relaxation of the material of the first 20 and second 30 part, this small amount would be collected in the safety chamber 40, which is closed downstream, with respect to the container 1, by the second sealing portion 42.

Therefore, in the first configuration, the safety chamber 40 is closed with respect to the storage chamber 31 by the first sealing portion 41 and with respect to the passage opening 23, i.e., the interior of the container 1, by the second sealing portion 42.

The storage chamber 31 has a storage volume V1 and the safety chamber 40 has a storage volume V2.

In one embodiment, the storage volume V2 of the safety chamber 40 is smaller than the storage volume V1 of the storage chamber 31. Therefore, the ratio of the storage volume V2 of the safety chamber 40 to the storage volume V1 of the storage chamber 31 is less than 1.

Preferably, the ratio of the storage volume V2 of the safety chamber 40 to the storage volume V1 of the storage chamber 31 is less than 0.1, more preferably less than 0.01.

In one embodiment, the first part 20 and the second part 30 comprise respective engagement portions 25, 26, 35, 36 which mutually engage, in the first configuration, to form the first sealing portion 41 and the second sealing portion 42.

Particularly, the first part 20 comprises a first engagement portion 25 and a second engagement portion 26 and the second part 30 comprises a first engagement portion 35 and a second engagement portion 36.

In the first configuration, the first engagement portion 25 of the first part 20 engages the first engagement portion 35 of the second part 30 to form the first sealing portion 41 and the second engagement portion 26 of the first part 20 engages the second engagement portion 36 of the second part 30 to form the second sealing portion 42.

Figure 2:
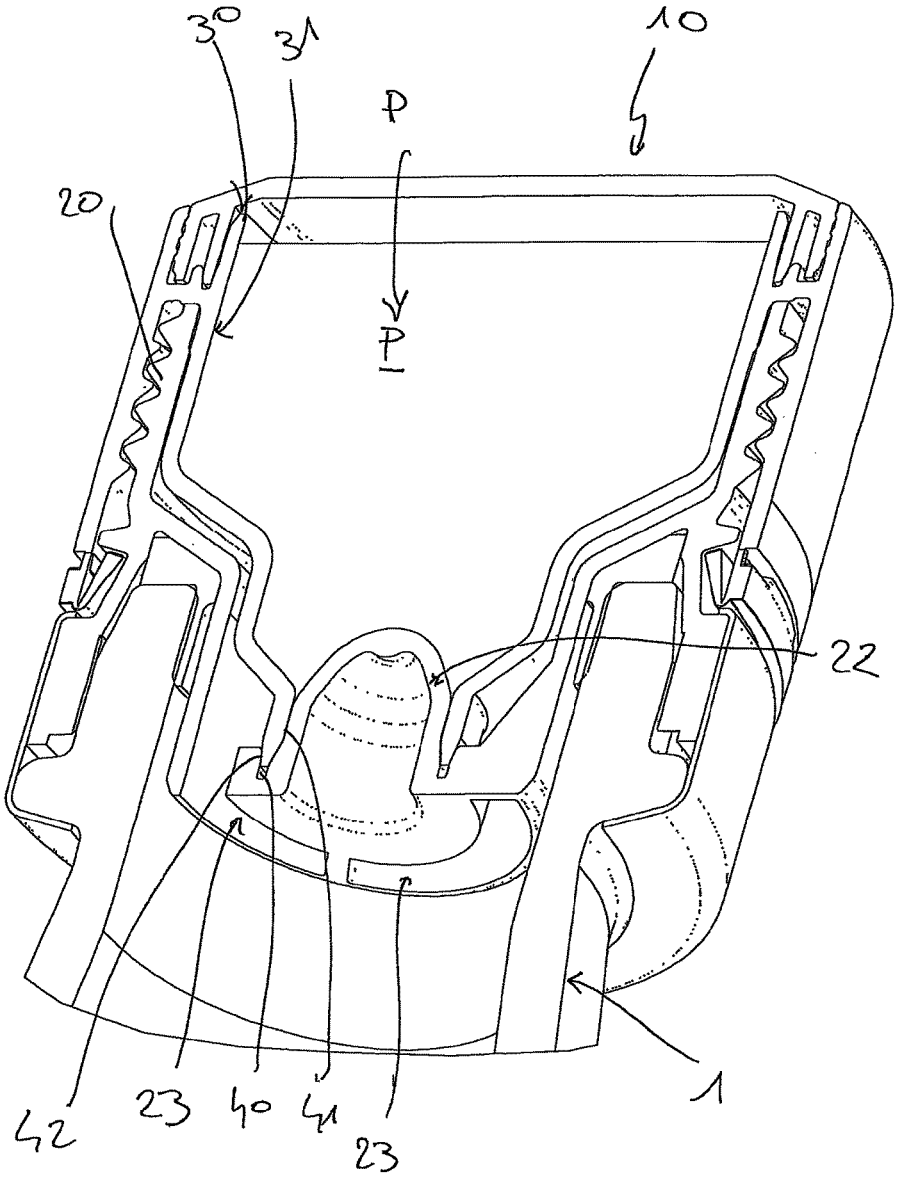
FIG. 2 shows a cross-sectional perspective view of the closure of FIG. 1.

In the example of FIGS. 1 to 3, in the first configuration, the second engagement portion 26 of the first part 20 engages the second engagement portion 36 of the second part 30 to thereby maintain the first engagement portion 35 of the second part 30 engaged with the first engagement portion 25 of the first part 20.

In the example of FIGS. 4 and 5, the first part 20 and the second part 30 comprise respective third engagement portions 27 and 37. In the first configuration, the third engagement portion 27 of the first part 20 engages the third engagement portion 37 of the second part 30 to thereby maintain the first engagement portion 35 of the second part 30 engaged with the first engagement portion 25 of the first part 20 and the second engagement portion 36 of the second part 30 engaged with the second engagement portion 26 of the first part 20. In this example, the third engagement portion 27 of the first part 20 comprises an annular abutment wall and the third engagement portion 37 of the second part 30 comprises an annular rib.

In one embodiment, the first sealing portion 41 is formed at the dispensing opening 32 to close such dispensing opening 32.

In the example of FIGS. 1 to 3, the second sealing portion 42 is arranged radially outside the first sealing portion 41.

In the example of FIGS. 4 and 5, the second sealing portion 42 is arranged below the first sealing portion 41 along the longitudinal direction X-X. In this embodiment, the safety chamber 40 is defined by an annular recess formed in the closing member 22.

In one embodiment, in the second configuration, the second part 30 is disengaged from the first part 20. Conveniently, the pitch and length of the threaded portion 29 of the first part 20 and the threaded portion 33 of the second part 30 will be chosen such that the storage chamber 31 dispenses the whole product P into the container 1 when the second part 30 can be removed from the first part 20.

If the product P is required to be mixed with the liquid in the container 1 before removal of the second part 30 from the first part 20, the first part 20 and the second part 30 may be configured such that, in the second configuration, the second part 30 is still coupled to the first part 20 and closes the pouring orifice 21. In this configuration the user may also shake the container 1 to cause the product P and the liquid in the container 1 to be homogeneously mixed. In this embodiment, the second part 30 is movable relative to the first part 20 between the second configuration and a third configuration in which the second part 30 disengages from the first part 20 and opens the pouring orifice 21.

The above disclosure clearly shows that the present invention fulfills the intended objects. Those skilled in the art will obviously appreciate that a number of changes and variants may be made to the arrangements as described hereinbefore to meet incidental and specific needs.

All of these variants and changes fall within scope of the invention, as defined in the following claims.

We claim:

1. A closure, comprising:

a first part able to be attached to a liquid container, said first part having a pouring orifice for pouring contents of the container; and a second part removably coupled to the first part to close and open said pouring orifice, said second part being moveable relative to said first part between a first configuration and a second configuration;

wherein:

the second part comprises a storage chamber for storing a product to be dispensed into the container and a dispensing opening for allowing the product to flow out of the storage chamber toward an interior of the container, the first part comprises a closing member and at least one passage opening, said at least one passage opening is able to put the dispensing opening of the storage chamber in communication with the interior of the container, in said first configuration, said closing member engages said dispensing opening to close said dispensing opening, upon first opening, said second part moves relative to said first part from the first configuration to the second configuration to cause said dispensing opening to disengage from said closing member and allow the product in the storage chamber to flow out into the container through the dispensing opening and said at least one passage opening, wherein in said first configuration, said first part engages said second part to form a first sealing portion, a second sealing portion, and a safety chamber arranged between the first sealing portion and the second sealing portion, and wherein in said first configuration, said safety chamber is closed toward the storage chamber by said first sealing portion and is closed toward said at least one passage opening by said second sealing portion, the second sealing portion thereby preventing said product from reaching the interior of the container in case of leaking of the product from the first sealing portion.

2. A closure as claimed in claim 1, wherein said second sealing portion is placed downstream from said first sealing portion in a direction of outflow of the product from the storage chamber toward said at least one passage opening.

3. A closure as claimed in claim 1, wherein:

said first part and said second part comprise respective engagement portions which mutually engage in said first configuration to form the first sealing portion and the second sealing portion, said first part comprises first and second engagement portions, said second part comprises first and second engagement portions, and in said first configuration:

the first engagement portion of the first part engages the first engagement portion of the second part to form the first sealing portion, and the second engagement portion of the first part engages the second engagement portion of the second part to form the second sealing portion.

4. A closure as claimed in claim 3, wherein in said first configuration, the second engagement portion of the first part engages the second engagement portion of the second part to thereby maintain the first engagement portion of the second part engaged with the first engagement portion of the first part.

5. A closure as claimed in claim 1, wherein said first sealing portion is formed at said dispensing opening to close said dispensing opening.

6. A closure as claimed in claim 1, wherein said second sealing portion is arranged radially outside said first sealing portion.

7. A closure as claimed in claim 1, wherein:

said closure extends in a longitudinal direction, and said second sealing portion is arranged below said first sealing portion along said longitudinal direction.

8. A closure as claimed in claim 1, wherein in said second configuration, said second part is disengaged from the first part.

9. A closure as claimed in claim 1, wherein:

said storage chamber has a storage volume V1, said safety chamber has a storage volume V2, and a ratio of the storage volume V2 of the safety chamber to the storage volume V1 of the storage chamber is less than 1:1.

10. A closure as claimed in claim 1, wherein said storage chamber comprises:

a tubular element having on a lower portion said dispensing opening and on an upper portion a filling opening for filling said storage chamber with said product to be dispensed; and a lid fixed to said tubular element for closing with seal said filling opening.

11. A closure as claimed in claim 10, wherein said lid is welded or glued to said tubular element for closing with seal said filling opening.

12. A closure as claimed in claim 10, wherein said lid is fixed with seal with said tubular element through members for fixing and sealing.

13. A closure as claimed in claim 12, wherein said members for fixing and sealing are configured to form a removable fixing of said lid.

14. A closure as claimed in claim 10, wherein:

said dispensing opening has a dispensing area, said filling opening has a filling area, and said filling area is greater than said dispensing area.

15. A closure as claimed in claim 1, wherein:

said storage chamber has a storage volume V1, said safety chamber has a storage volume V2, and a ratio of the storage volume V2 of the safety chamber to the storage volume V1 of the storage chamber is less than 0.1:1.

16. A closure, comprising:

a first part configured to attach to a container; and a second part configured to removably couple to the first part;

wherein the first part comprises a pouring orifice for pouring contents of the container, wherein the second part is movable relative to the first part between a first configuration and a second configuration, wherein when the second part is coupled to the first part, the pouring orifice is closed, wherein when the second part is not coupled to the first part, the pouring orifice is open, wherein the first part comprises a closing member and at least one passage opening, wherein the second part comprises a storage chamber for storing a product to be dispensed into the container, and a dispensing opening for allowing the product to flow from the storage chamber toward an interior of the container, wherein the at least one passage opening is configured to allow communication between the dispensing opening and the interior of the container, wherein in the first configuration, the closing member engages the dispensing opening to close the dispensing opening, wherein in the first configuration, the first part engages the second part to form a first sealing portion, a second sealing portion, and a safety chamber between the first sealing portion and the second sealing portion, wherein in the first configuration, the safety chamber is closed toward the storage chamber by the first sealing portion and is closed toward the at least one passage opening by the second sealing portion, the second sealing portion preventing the product from reaching the interior of the container in case of leaking of the product via the first sealing portion, and wherein upon first opening, the second part moves relative to the first part, from the first configuration to the second configuration, to cause the dispensing opening to disengage from the closing member and to allow the product to flow from the storage chamber into the container through the dispensing opening and the at least one passage opening.

17. The closure of claim 16, wherein in the second configuration, the second part is coupled to the first part.

18. The closure of claim 16, wherein in the second configuration, the second part is not coupled to the first part.

19. A closure, comprising:

a first part configured to attach to a container; and a second part removably coupled to the first part;

wherein the first part comprises a pouring orifice for pouring contents of the container, wherein the second part is movable relative to the first part between a first configuration and a second configuration, wherein when the second part is coupled to the first part, the pouring orifice is closed, wherein when the second part is not coupled to the first part, the pouring orifice is open, wherein the first part comprises a closing member and at least one passage opening, wherein the second part comprises a storage chamber for storing a product to be dispensed into the container, and a dispensing opening for allowing the product to flow from the storage chamber toward an interior of the container, wherein the at least one passage opening is configured to allow communication between the dispensing opening and the interior of the container, wherein in the first configuration, the closing member engages the dispensing opening to close the dispensing opening, wherein in the first configuration, the first part engages the second part to form a first sealing portion, a second sealing portion, and a safety chamber between the first sealing portion and the second sealing portion, wherein in the first configuration, the safety chamber is closed toward the storage chamber by the first sealing portion and is closed toward the at least one passage opening by the second sealing portion, the second sealing portion preventing the product from reaching the interior of the container in case of leaking of the product via the first sealing portion, and wherein upon first opening, the second part moves relative to the first part, from the first configuration to the second configuration, to cause the dispensing opening to disengage from the closing member and to allow the product to flow from the storage chamber into the container through the dispensing opening and the at least one passage opening.

20. The closure of claim 19, wherein in the second configuration, the second part is not coupled to the first part.

* * * * *